United States Patent [19]

Mercer

[11] 4,263,246

[45] Apr. 21, 1981

[54] NET COVERING FOR ARTICLES

[75] Inventor: Frank B. Mercer, Blackburn, England

[73] Assignee: Netlon Limited, England

[21] Appl. No.: 56,517

[22] Filed: Jul. 11, 1979

[30] Foreign Application Priority Data

Jul. 14, 1978 [GB] United Kingdom ..... 29886/78

[51] Int. Cl.[3] ..... B29C 13/02

[52] U.S. Cl. ..... 264/230; 215/DIG. 6; 264/DIG. 71

[58] Field of Search ..... 264/230, DIG. 71; 156/86; 215/1 C, 12 R, DIG. 6

[56] References Cited

U.S. PATENT DOCUMENTS

| | | | |
|---|---|---|---|
| 3,128,895 | 4/1964 | Nelle | 215/12 R |
| 4,014,724 | 3/1977 | Rausing | 264/230 X |
| 4,018,640 | 4/1977 | Amberg | 264/230 X |
| 4,092,382 | 5/1978 | Heckman | 264/230 X |
| 4,126,238 | 11/1978 | Rausing | 264/230 X |

*Primary Examiner*—Thomas P. Pavelko

*Attorney, Agent, or Firm*—Holman & Stern

[57] ABSTRACT

A tubular net has unorientated annular zones, and orientated annular zones which contract transversely upon heat shrinking; the net can be used for packaging or sleeving, the unorientated zones acting as end closures or neck holders and the ends of the orientated zones being heat shrunk to retain the other end of the article or articles being packaged or sleeved.

4 Claims, 4 Drawing Figures

21
22
23
24
24'
25
25'
26
26'
27
28
29
30
2
3

NET COVERING FOR ARTICLES

BACKGROUND OF THE INVENTION

This invention relates to a method of applying a net covering to one or more articles, comprising inserting the article(s) in a tubular netting sleeve, and also to a specific tubular net for carrying out the method. The article may be a bottle or any other suitable article, and the net may cover a group of articles.

Oriented diamond mesh sleeves have been used to protect bottles. The net had a constant stretch width, and as the diameter had to be sufficient for the net to pass over the widest part of the bottle, the net was very slack at the neck and did not fit neatly. The sleeves were heat-sealed or clip sealed above the top of the bottle, and sometimes this was done before putting the sleeve on the bottle. However, the sleeve had to be placed on before filling the bottle and the operation could not be carried out in the bottle manufacturing plant.

An attempt has been made to improve the sleeving operation by integrally extruding a diamond mesh sleeve of substantially constant diameter but in alternate zones of wide mesh angles and narrow mesh angle, i.e. of short meshes and long meshes. The dies revolved faster in the short mesh zone. The short mesh zone fitted around the neck of the bottle. The sleeves were not economical.

Unperforated sleeves made from expanded polystyrene are in use, but they cannot shrink sufficiently to cover the neck of the bottle in a satisfactory manner and normally the neck is left projecting.

Orientated diamond mesh sleeves are extensively used for packaging groups of articles, with a clip at each end, or even a heat seal.

THE INVENTION

The method of the invention is set forth in claim 1, and the invention also provides the net of claim 5, for use in the method.

Orientated means molecularly orientated.

The sleeve is preferably applied to the article(s) so that its end projects and is then heat shrunk so as to form an annulus at its end.

The heat shrinkage can be formed by the very fast application of hot air or radiant heat, avoiding any substantial transfer of heat to the article(s). On heat shrinking, the orientated zone tries to revert to its condition before orientation and contracts in the transverse or circumferential sense, producing radial contraction of the orientated zone as a whole.

The net concerned can be made as an integral plastics material net by forming the net, and stretching axially (machine direction) spaced zones to molecularly orientate them, leaving the remaining zones in their original, unorientated condition. Some melt flow orientation of the "unorientated" zones may have occurred during extrusion, but this is not considered to be substantial in the context of the present specification, and the unorientated zones have never been substantially orientated.

The method of the invention is particularly useful for sleeving bottles, as set forth in claim 3, but the method could be used for covering other individual articles or for unitising or covering groups of articles such as oranges or tomatoes, or tubs of for instance cream, or can lids.

In general, the unorientated zone provides a good, cheap end closure or retainer, and the other end is closed by heat shrinking, so that for instance metallic clips can be avoided altogether. In the case of a bottle, the sleeve can be made to grip the bottle from just under the neck, down the transition zone between the neck and the body and down the body. The sleeve, apart from the neck portion, is molecularly orientated and is therefore strong and very economical, and the sleeve can reduce the forces of the glass particles if the bottle breaks and explodes; furthermore, because the sleeve also engages the neck of the bottle, it can reduce the tendency of the neck portion of the bottle to be blown off like a projectile. Apart from this, the sleeve can have an attractive appearance, fitting neatly at the neck of the bottle where the sleeve is not orientated and can be in tension over the whole of the bottle, in particular over the transition zone between the neck and the body of the bottle; the unorientated zone at the neck of the bottle is supported by the widening of the bottle and does not tend to slide down. Furthermore, the sleeve itself increases impact resistance, for instance when one bottle bangs against another, and the bottle could be of thinner glass than previously; this effect is enhanced by using biplanar nets as the intersections are relatively thick. The sleeve also reduces impact noises for instance in bottling plants. In addition, the surface of the bottle is made less slippery so that the bottle is easier to handle, e.g. when being lifted from supermarket shelves. The invention is particularly useful for light-weight, non-returnable bottles. The sleeves are also capable of being applied to the bottles at high speed, either in the bottle manufacturing plant or after the bottles are filled. If the sleeves are applied before filling, then the label may be stuck to the sleeve, or through apertures in the net to the bottle itself, or to both the bottle and sleeve. If the sleeve is applied after the label has been affixed to the bottle, the sleeve will prevent scuffing of the label.

The unorientated net is preferably of diamond mesh (two sets of strands at an angle to each other and each at an angle to the longitudinal direction and no substantially longitudinal strands) as such net is easy to molecularly orientate by axial (machine direction) stretching but nonetheless contracts transversely on heat shrinking, particularly if there is longitudinal restraint—the unorientated net can be stretched to form a diamond mesh or further stretched to form a hexagonal mesh on stretching the intersections between the strands. The diamond mesh orientated zone can give a good fit on the normally tapered transition zone of the bottle between the neck and the body, and on the body itself if the body is not parallel sided, provided the net is under at least slight longitudinal and circumferential tension. In general, the orientated zones will be radially expandible to accommodate the article(s) concerned and the orientated zones will conform well to the shape of the article if the article does not have abrupt changes in diameter.

In theory it is possible to use square mesh net (one set of strands extending in the machine direction and the other set of strands in the transverse direction), but it is difficult to transversely stretch square mesh net in a continuous process in order to produce the discontinuous zones required by the present invention. Furthermore heat shrinking of the whole length of the orientated zone would normally be required to give a good fit over the article(s).

In general, the orientated zones will be longer than the unorientated zones. Each unorientated zone may be a very narrow annular band, e.g. only 0.5 to 1 cms long, for general purposes. However, for a bottle, it is preferred that the unorientated zone should be at least 3.5 cms long so as to provide a good grip on the neck and on the initial part of the transition zone.

BRIEF DESCRIPTION OF THE DRAWINGS

The invention will be further described, by way of example, with reference to the accompanying drawings, in which.

PARTICULAR DESCRIPTION OF EMBODIMENTS OF THE INVENTION

Figure 1:
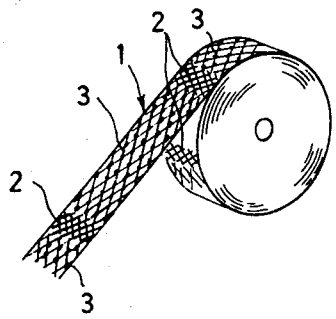
FIG. 1 is a view of a continuous reel supply of tubular net in accordance with the invention.

FIG. 1 shows a reel of tubular net 1 which comprises axially-spaced annular zones 2 which are not substantially molecularly orientated, connected by heat-shrinkable zones 3 which have been molecularly orientated and which contract transversely upon heat shrinking with longitudinal restraint. The net has been manufactured by extrusion of a polyolefin (such as a resin blend of 50% high density polyethylene and 50% low density polyethylene) in an integral extrusion process, preferably forming bi-planar net using counter-rotating dies in accordance with British Patent Specification No. 836,555; the dies may have discrete orifices as in FIG. 12 of that Patent Specification, but preferably the orifices are in the form of open slots. The tubular net is then passed into an arrangement for stretching the net in the longitudinal direction in an intermittent manner, leaving the zones 2 unstretched whilst stretching the zones 3. The net is then wound up continuously on reels.

Figure 2A:
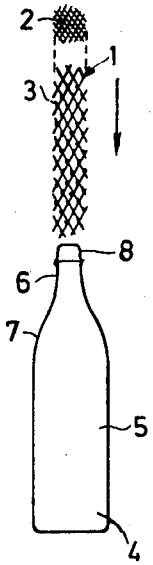
FIGS. 2*a* to 2*e* show the application of a sleeve to a bottle, in accordance with the invention.
Figure 2B:
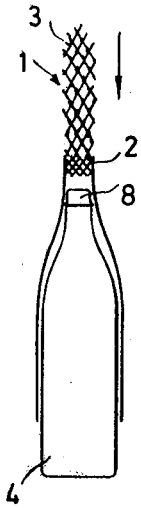
Figure 2C:
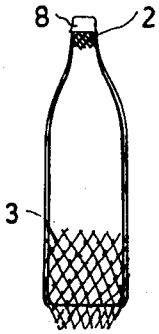
Figure 2D:
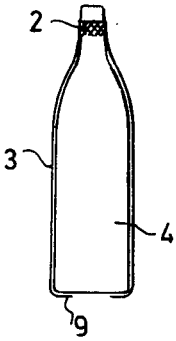
Figure 2E:
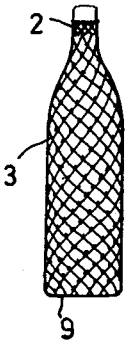
Figure 2F:
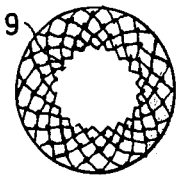
FIG. 2*f* is a view of the base of the bottle after the application of the sleeve.

FIGS. 2*a* to 2*f* show the application of the net to a bottle 4 which is of a normal type having a parallel-sided body 5, a neck 6 and a tapered transition zone 7. The neck 6 carries protruberances 8 for any suitable type of closure. The procedure is as follows:

1. Pass the orientated zone 3 of the net 1 from a continuous supply reel over the outer surface of the bottle 4 (FIGS. 2*a* and 2*b*);

2. Cut the net 1 just above the unorientated zone 2 (FIG. 2*b*);

3. Pass the net 1 on down over the bottle 4 until the unorientated zone 2 is below the protruberances 8, when the bottom part of the orientated zone 3 should project down below the base of the bottle 4 (FIG. 2*c*);

4. Heat shrink the base of the net 1 to secure the sleeve to the bottom part of the bottle 4 (FIG. 2*d*); the bottom part of the net 1 forms an annulus 9 on the base of the bottle 4, lying at right angles to the axis of the bottle 4 (see FIG. 2*f*);

5. Only if desired (not essential), heat shrink the remainder of the orientated zone 3 so that the net 1 grips the bottle 4 tightly (FIG. 2*e*); this heat shrinking is performed by blowing hot air onto the net 1, and for the particular polyolefin referred to above, a hot air temperature of 130° to 155° C. is suitable.

Figure 3:
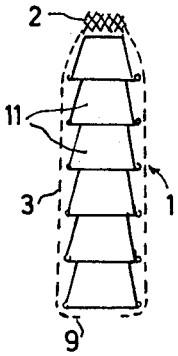
FIG. 3 shows the application of a sleeve to a group of articles, in accordance with the invention.

FIG. 3 shows the application of the invention to unitising a group of articles. In the particular illustration, the articles are shown as tubs 11 of for instance cream, but any suitable article could be covered. The same references are used for identical or equivalent items. The net is applied generally as above, and it will be seen that the unorientated zone 2 acts as an end closure, the tubs 11 being unable to pass therethrough. The other end of the package is closed by the annulus 9.

Figures 4, 5A, 5B, 5C:
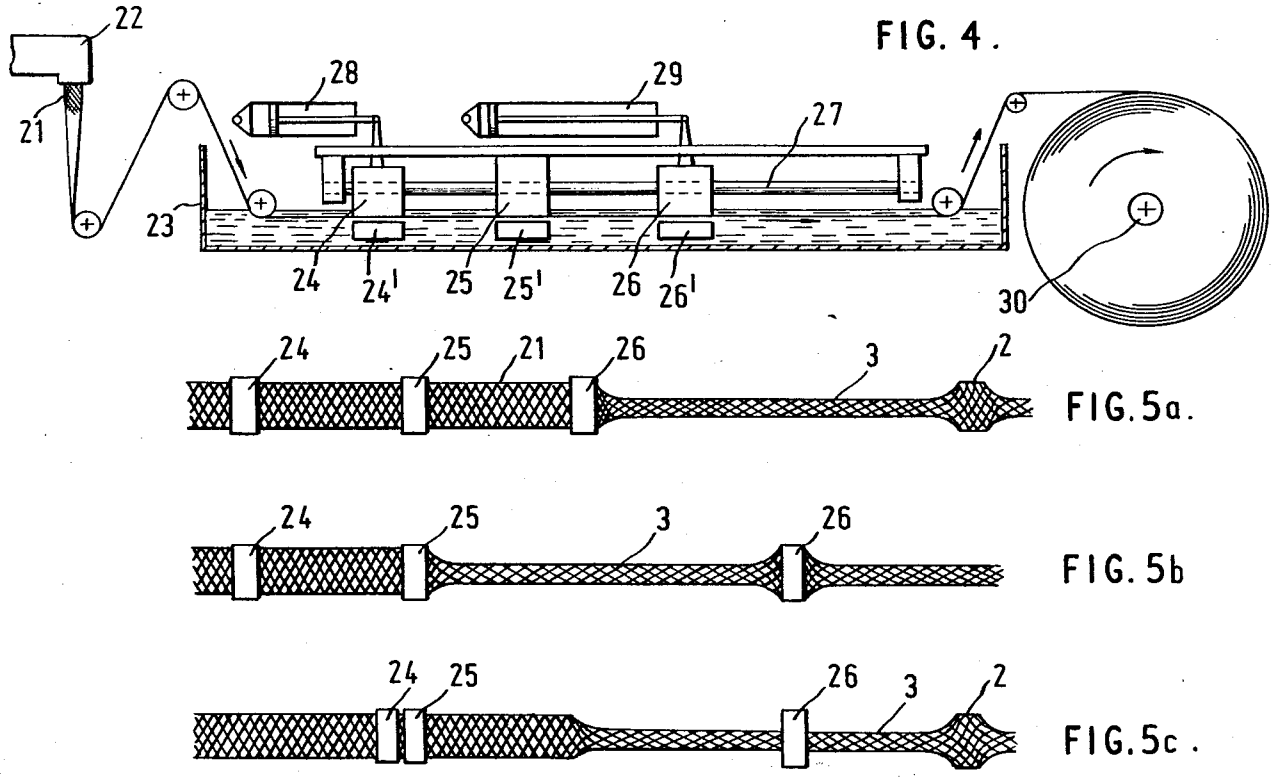
FIG. 4 is a schematic representation of a plant for making tubular net in accordance with the invention.
FIGS. 5*a* to 5*c* show how the net is stretched in the plant of FIG. 4.

FIG. 4 shows in a schematic manner one continuous plant for manufacturing net in accordance with the invention.

Bi-planar diamond net 21 is extruded in an extruder 22 and hauled off and cooled, in a well known manner. The net 21 then passes into a hot water bath 23 containing a special stretching machine, which is believed to be inventive.

The stretching machine has three pairs of clamps, 24, 24', 25, 25' and 26, 26'. Each clamp has clamping faces of substantial length. The lower jaw 24', 25' and 26' of each clamp is lowerable and raisable using conventional guides and pneumatic rams (not shown), for clamping the net 21. The centre clamp 25, 25' is fixed in position, whilst the others 24, 24' and 26, 26' are carried on a slideway 27 and actuated by pneumatic rams 28 and 29, generally in a known manner. All the rams are controlled by a conventional cam-type program unit (now shown).

FIGS. 5*a* to 5*c* show how the net 21 is stretched:

1. (FIG. 5*a* to FIG. 5*b*). All clamps closed; clamp 26, 26' moves to right and stretches.

2. (FIG. 5*b* to FIG. 5*c*). Only clamp 24, 24' closed; clamp 24, 24' moves to right to feed net 21.

3. (FIG. 5*c* to FIG. 5*a*). Only clamp 25, 25' closed; return to starting position.

As an example, the strokes of the clamps 24, 24' and 26, 26' can be 15 cms and 60 cms respectively. The length of the unorientated zone 2 is roughly equivalent to the length of the clamping faces of the clamp 26, 26'.

The net 1 is then wound on a reel 30.

The reel 30, when full, is used for sleeving. The net 1 is drawn off over a roll 31 and over a spring-loaded internal expander 32, traction being obtained from spring-loaded drive belts 33. The expander 32 has jaws 34 (see FIG. 7) which will contract slightly to allow the unorientated zone 2 to pass over the expander 32; after the unorientated zone 2 has passed over and away from the expander 32, the orientated zone 3 will be expanded but only to an extent which will ensure that it passes over the neck of a bottle 4. The amount of expansion need not be great as it is only required to ensure that the bottle neck does not foul the net 1. The expander 32 is suspended from the roll 31 by a "shepherd's crook" 35, in a known manner.

The net 1 is cut into lengths by a cutter 36 which cuts the net 1 just after each zone 2, the net 1 preferably having an intermittent motion so that the cutter 36 severs the net 1 when the net 1 is stationary. The net 1 then passes into a sleeving machine 37 which is indicated schematically.

The bottles 4 are carried on an intermittently moving conveyor 38 which locates the bottles 4 over circular openings 39. Each bottle 4 is lifted in turn into the sleeving machine 37 by a conventional mechanism 40. The belts 41 can be stationary or even have their inner sides moving upwards to assist the upwards movement of the bottle 4. The belts 33, 41 then move in co-operation so as to draw the net 1 from the reel 30 and push it over the bottle 4 until the unorientated zone 2 has reached the correct position. The belts 33, 41 both stop for cutting just before the net 1 is fully down over the bottle 4, and then the belts 41 continue. When the bottle 4 is sleeved as in FIG. *2c*, it is lowered back onto the conveyor 38, the belts 41 continuing to move so as not to drag the net 1 off the bottle 4. The conveyor 38 then carries the bottles 4 over radiant electric heaters 42 which heat the projecting bottom end of the net sleeve to about 160° C. and the sleeve shrinks as shown in FIG. *2d*.

Figures 6, 7:
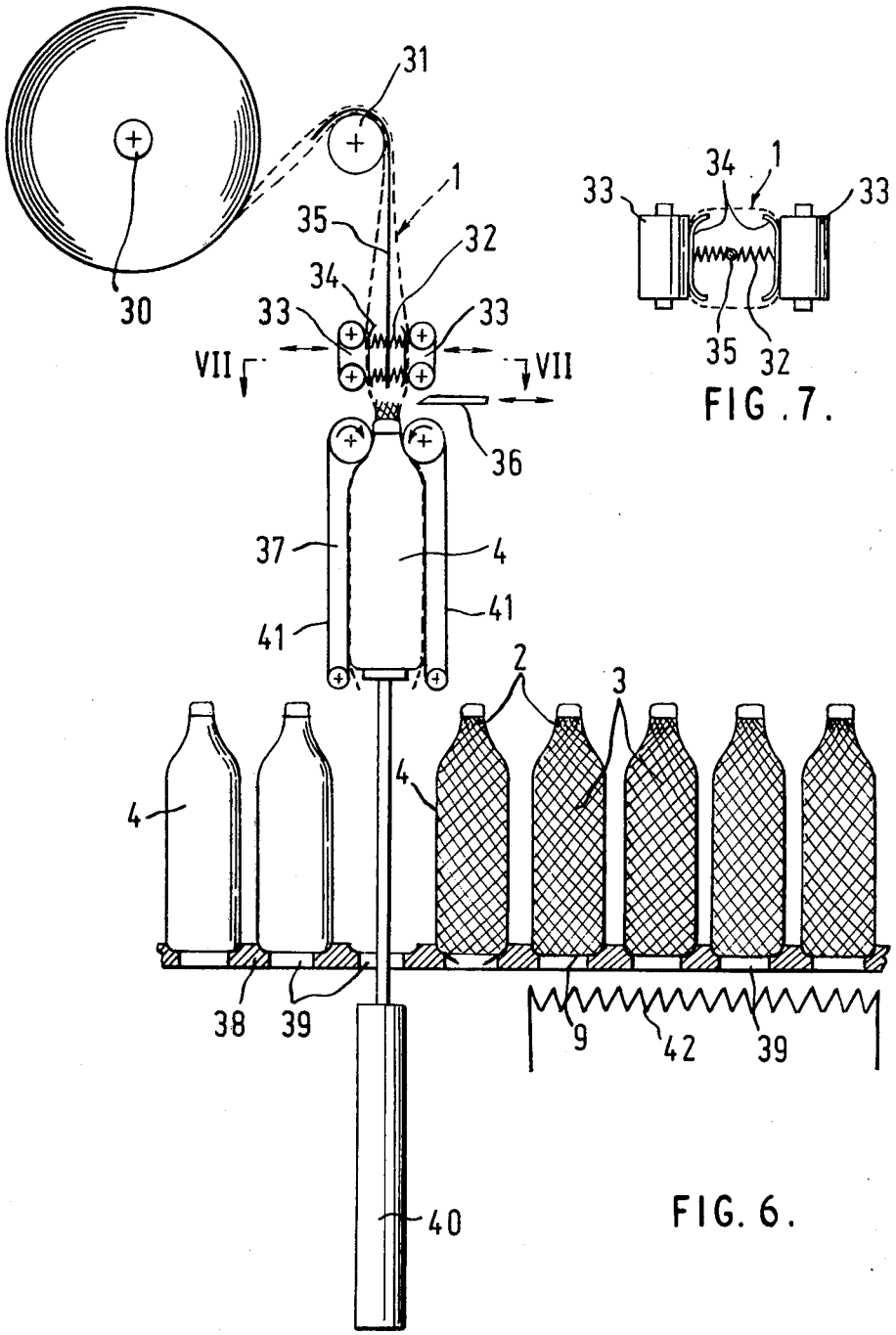
FIG. 6 is a schematic representation of a bottle sleeving plant in accordance with the invention.
FIG. 7 is a section along the line VII—VII in FIG. 6, on an enlarged scale.

As an alternative to using the plant of FIG. 6, sleeving could be carried out by hand.

I claim:

1. A method of applying a plastics material net covering to at least one article comprising:

providing a tubular netting sleeve which has at least one substantially unorientated zone and at least one orientated annular zone and terminates at an orientated zone;

inserting the article into the orientated zone end of the sleeve, the unorientated zone preventing the article(s) passing out of the other end of the sleeve; and heat shrinking the open end portion of the orientated zone to secure the sleeve on the article(s).

2. The method of claim 1, wherein the net is of bi-planar mesh having at least two sets of strands at an angle to each other and each at an angle to the longitudinal direction of the sleeve, and no continuous substantially longitudinal strands.

3. The method of claim 1, wherein the article is a bottle which has a neck, comprising drawing the sleeve over the bottle from the neck end, whereby the orientated zone covers the body of the bottle and the unorientated zone fits around the neck of the bottle.

4. The method of claim 3, wherein the net is of bi-planar mesh having at least two sets of strands at an angle to each other and each at an angle to the longitudinal direction of the sleeve, and no continuous substantially longitudinal strands.

* * * * *